United States Patent [19]

Lechner et al.

[11] Patent Number: 4,820,002

[45] Date of Patent: Apr. 11, 1989

[54] SAFETY INTERLOCK

[75] Inventors: Lloyd Lechner; Kent Thomas, both of Mayville, Wis.

[73] Assignee: Tab Products Company, Palo Alto, Calif.

[21] Appl. No.: 124,614

[22] Filed: Nov. 24, 1987

[51] Int. Cl.[4] ..... E05C 7/06

[52] U.S. Cl. ..... 312/221; 312/220; 384/23

[58] Field of Search ..... 312/216–221; 384/58, 19, 56, 42, 36, 23, 20

[56] References Cited

U.S. PATENT DOCUMENTS

| | | | |
|---|---|---|---|
| 113,871 | 1/1871 | Gibbons | 384/23 |
| 3,404,929 | 10/1968 | Wright et al. | 312/216 |
| 3,883,200 | 5/1975 | Latham | 312/216 |
| 3,888,558 | 6/1975 | Himsl | 312/216 |
| 3,927,918 | 12/1975 | Dobbratz | 384/23 |
| 4,240,685 | 12/1980 | Terlecki | 312/217 |
| 4,272,138 | 6/1981 | Stark | 312/216 |
| 4,441,767 | 4/1984 | Stark | 312/221 X |
| 4,447,098 | 5/1984 | Parker | 312/221 |
| 4,480,883 | 11/1984 | Young | 312/220 |
| 4,637,667 | 1/1987 | Reid et al. | 312/221 X |

*Primary Examiner*—Kenneth J. Dorner
*Assistant Examiner*—Thomas A. Rendos
*Attorney, Agent, or Firm*—Donald Cayen

[57] ABSTRACT

A filing cabinet includes a safety interlock that prevents more than one drawer from being opened at a time. The safety interlock comprises a column of endwise abutting catches mounted to the cabinet wall for vertical reciprocation thereon. The ends of the catches are formed with tabs. The tabs of adjacent catches cooperate to define gaps of predetermined spacing. Actuator means on each cabinet drawer are aligned with the catch gaps. When a selected drawer is opened, the actuator means thereon enters the associated gap and displaces upwardly any higher catches. Upward displacement causes the gaps between higher adjacent catches to be displaced into the paths of the actuator means of any higher drawers, thereby preventing any higher drawers from being opened. The retainer of an open drawer blocks upward displacement of any lower catches, thereby preventing lower drawers from being opened. A slide is reciprocably mounted on each retainer. The slide remains in the gap to maintain catch upward displacement when the drawer is opened such that the retainer passes completely through the gap. The catches are severable approximately in line with the top of each drawer to enable easy field conversion of cabinet drawers without affecting interlock components associated with non-converted drawers.

6 Claims, 5 Drawing Sheets

SAFETY INTERLOCK

BACKGROUND OF THE INVENTION

1. Field of the Invention

This invention pertains to safety equipment, and more particularly to apparatus for enhancing the safety of persons using filing cabinets.

2. Description of the Prior Art

Multi-drawer filing cabinets are well known. A commonly recognized danger with conventional filing cabinets is that heavily loaded drawers tend to tip the cabinet onto a person opening the drawers.

To reduce the likelihood of a loaded cabinet tipping when opened, various types of interlock mechanisms have been developed. The primary purpose of the interlocks is to prevent more than one drawer from being opened at a time. However, prior interlock devices suffer from certain disadvantages. For example, the cabinets disclosed in U.S. Pat. Nos. 3,404,929; 3,883,200; and 3,888,558 permit opening more than one drawer if the drawers are opened simultaneously. Certain other interlocks are capable of being easily overridden, thereby defeating their purpose. The cabinets disclosed in U.S. Pat. Nos. 4,240,685; 4,272,138; and 4,441,767 utilize vertically reciprocating lift bars in combination with rollers, springs, or lock dogs. The multiplicity of parts renders the cabinet interlocks of the three foregoing patents undesirably expensive and prone to malfunction.

The blocking device of U.S. Pat. No. 4,480,883 employs multi-piece fork shaped cam elements that are not positively restrained in place when a cabinet drawer is opened. Rather, opening a drawer raises the cam elements to unrestrained and unstable positions. Accidental jarring of an open cabinet can cause the cam elements to fall to a stable position, and a second drawer can then be opened. In addition, an accidentally displaced cam element prevents the associated drawer from being closed without damaging the cam element or other components.

Thus, a need exists for an improved mechanism for controlling the opening of filing cabinet drawers.

SUMMARY OF THE INVENTION

In accordance with the present invention, a versatile safety interlock is provided that simply and reliably prevents opening more than one filing cabinet drawer at a time. This is accomplished by apparatus that includes a series of vertically reciprocable catches in combination with horizontally mounted drawer actuators.

The catches vertically reciprocate in a channel formed in one of the cabinet side walls. The catches are very simple in construction, being made as flat strips having generally rectangular cross sections. Each catch has a pair of tabs, which may be generally U-shaped. The tabs have legs that extend perpendicularly to the plane of the strip. The center leg of one U-shaped tab is preferably flush with the first end of the catch. The center leg of the other tab is recessed a short distance from the catch second end. The catches are stacked edgewise in a vertical column in the cabinet channel such that their respective first ends are in abutting contact with the second ends of the respective adjacent catches. As a result, vertical gaps exist between the tabs of adjacent catches. The catches are mounted to the cabinet with fasteners passing through slots in the strip sections.

The drawer actuators are preferably in two pieces. The first piece is a retainer fixedly attached to the side of each horizontally moveable drawer. The length of the retainer is such that its front end lies just behind the cabinet catch channel when the drawer is in the closed position.

The second actuator piece is a retainer slide that is received in a groove in the retainer. The slide is reciprocable within the retainer groove. Reciprocating travel is limited by fasteners passing through slots in the slide.

The front end of each retainer is fabricated with a tapered surface terminating in a generally pointed nose. The retainer is positioned vertically on the drawer such that the nose enters the gap between the flush and recessed tabs of two adjacent catches when the drawer is pulled to the opened position. As the drawer is pulled outwardly, the retainer tapered surface contacts and forces the catch located above that retainer to move upwardly. That catch in turn forces upwardly all the other catches above it in the cabinet channel. The catches located below the retainer of the opened drawer are not displaced. Consequently, the gap between the tabs associated with the open drawer is enlarged. Upwardly displacing all the catches above the retainer of the open drawer inherently displaces upwardly all the gaps between the adjacent catches located above the open drawer. The catches and retainers are so dimensioned that the side legs of the U-shaped catch tabs are raised to lie in the paths of the associated drawer retainers. Therefore, a higher drawer in the cabinet cannot be opened, because the retainer nose of that drawer will strike the tab side leg of the displaced catch located immediately below that retainer.

The gaps between adjacent catches lying below the open drawer remain undisplaced and therefore remain aligned with the associated retainers of the lower drawers. Nevertheless, drawers located in the cabinet under the open drawer cannot be opened. That is because the tapered surface of the retainer of the lower drawer is unable to force the catch above that retainer upwardly. Upward displacement is not possible because the retainer of the opened drawer lies in the path of the lower catches and blocks the upward catch movement necessary to open any of the lower drawers.

To permit full horizontal opening of a drawer past the catch channel in the cabinet wall, each retainer slide is designed to maintain the enlarged gap between the respective two adjacent catches even when the back end of the retainer is moved forwardly of the catch channel. Retention of the slide in the enlarged gap is caused by the abutment of an ear on the back end of the slide against the catches as the drawer is pulled to the fully opened position. The presence of the slide in the enlarged gap between the two adjacent catches blocks vertical displacement of lower catches and therefore prevents opening any lower drawers. When the open drawer is closed, the slide telescopes into the retainer.

Further in accordance with the present invention, the safety interlock is readily modified in the field to suit changed storage requirements of the cabinet user. Field modification is easily accomplished by utilizing catches having ends that are approximately in line with the top and bottom planes of the respective drawers. In that way, one or more drawers can be removed or interchanged without affecting or disassembling the interlock components of the undisturbed drawers.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended thereto.

Figure 1:
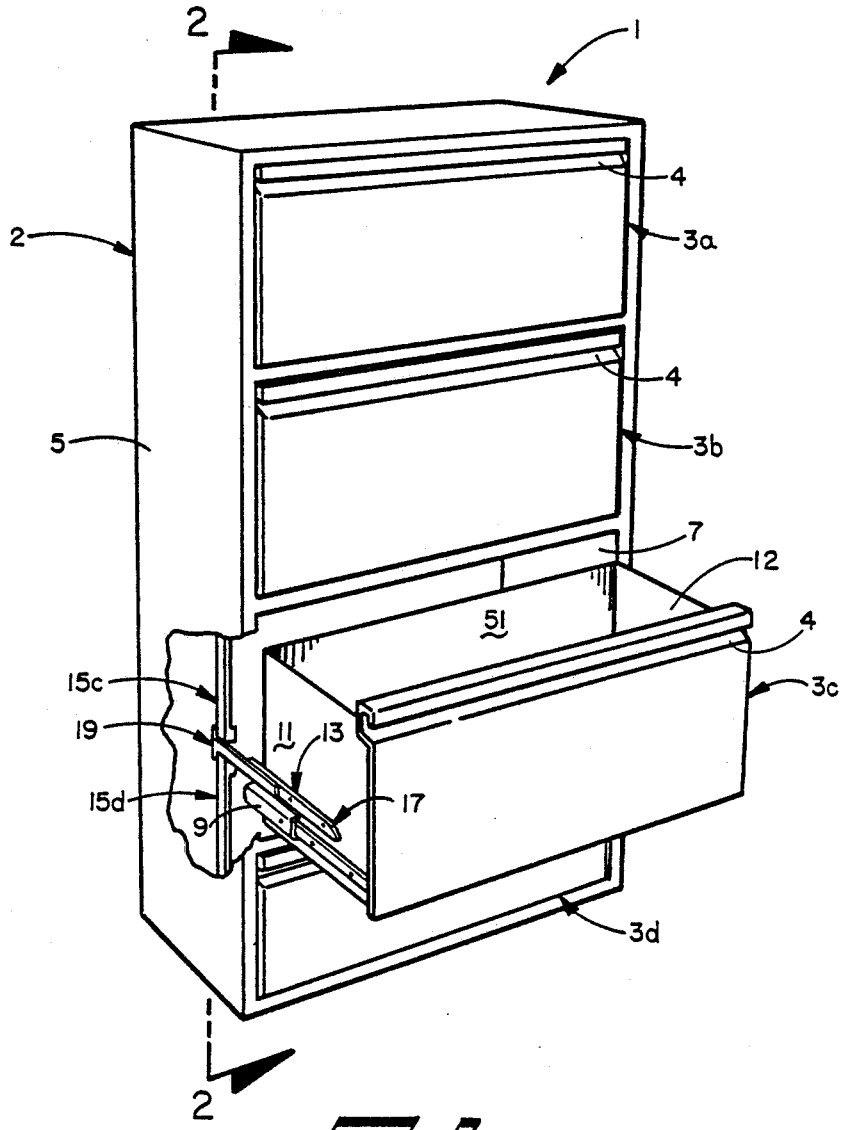
FIG. 1 is a perspective view of a typical multi-drawer filing cabinet that advantageously includes the safety interlock of the present invention.

Referring to FIG. 1, a filing cabinet 1 is illustrated that includes the present invention. The filing cabinet depicted is merely exemplary of a wide variety of equipment that has horizontally moveable drawers for storing supplies and data media.

The filing cabinet 1 has a housing 2 that encloses and supports the horizontally reciprocable drawers 3. The filing cabinet shown has four drawers 3*a*–3*d,* but it will be understood that the present invention may be used with cabinets having any number of drawers greater than one. Each drawer has a pull schematically represented at 4, which may be of any suitable design. The file cabinet housing 2 includes opposed side walls 5 and 7, to which are fastened conventional drawer suspension systems 9. The drawer suspension systems 9 are also attached to the side walls 11 and 12 of the respective drawers 3 for permitting smooth horizontal movement thereof, as is well known in the art.

Figure 2B:
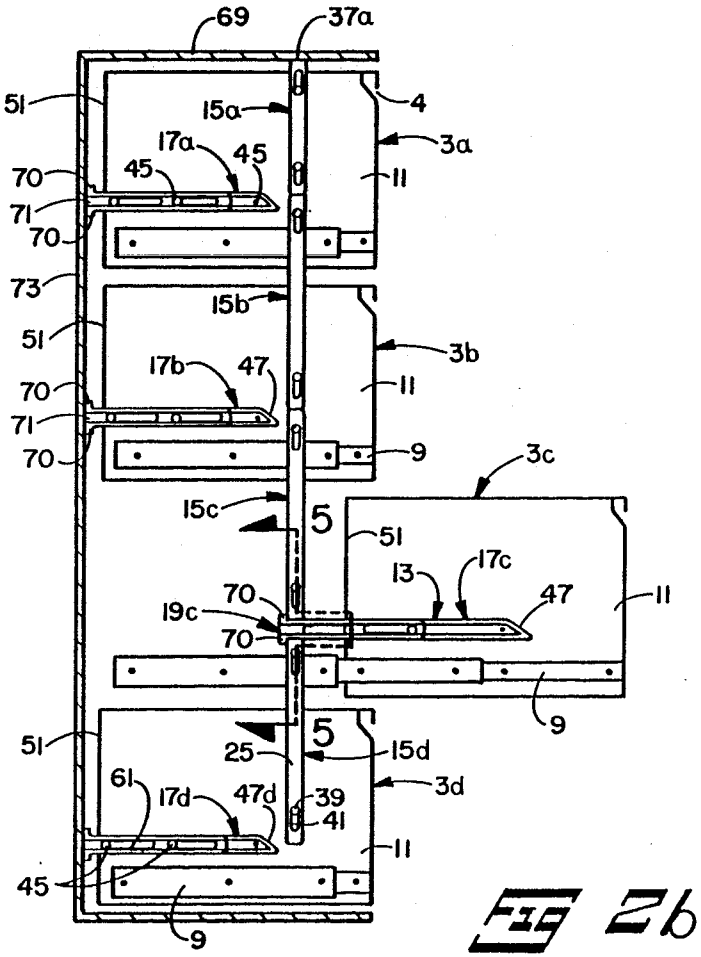
FIG. 2*b* is a cross sectional view taken along lines 2—2 of FIG. 1.
Figure 2A:
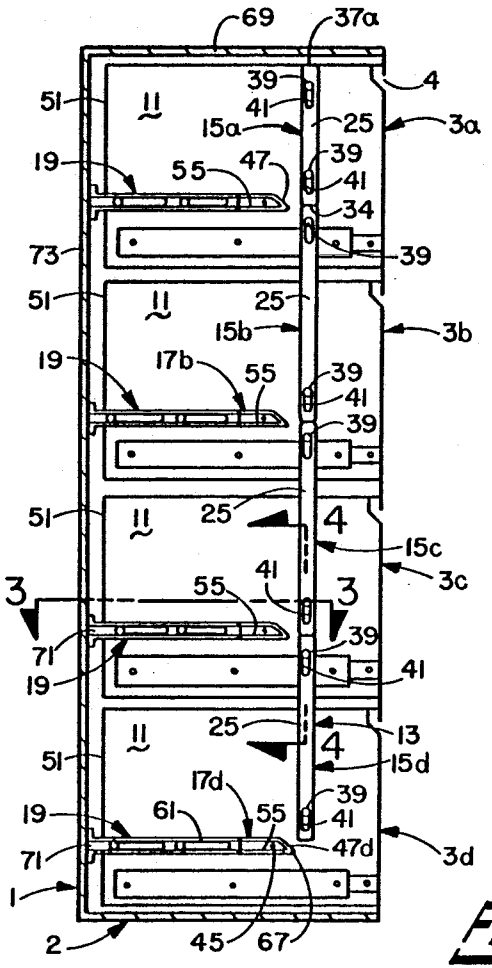
FIG. 2*a* is a cross sectional view taken along lines 2—2 of FIG. 1, but showing all the cabinet drawers in the closed position.
Figure 3:
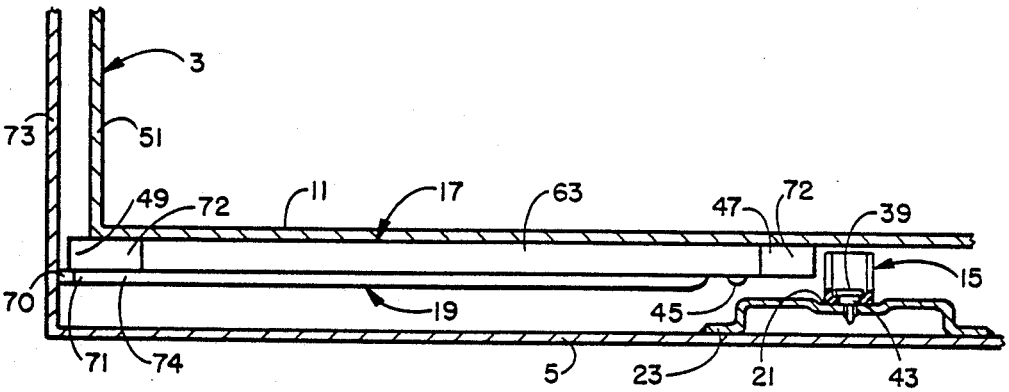
FIG. 3 is an enlarged partial cross sectional view taken along lines 3—3 of FIG. 2*a;*

In accordance with the present invention, the file cabinet 1 includes a safety interlock 13 that prevents more than one drawer 3 from being opened from the file cabinet housing 2 at a time. Referring also to FIGS. 2*a* and 2*b,* the safety interlock 13 comprises a catch 15, a retainer 17, and a retainer slide 19 associated with each drawer. The catches 15 are aligned vertically in a column. As best shown in FIG. 3, the catches are received in a shallow channel 21 formed in a housing side wall. In FIG. 3, the channel 21 is illustrated as being formed in a panel 23 welded or otherwise fastened to the cabinet side wall 5. However, the particular construction of the cabinet member that defines the catch channel is not critical to the invention.

Referring to FIGS. 2*a* and 2*b,* there is a catch 15*a*–15*d* corresponding to each of the drawers 3*a*–3*d,* respectively. Catches 15*b*–15*d* are identical. Catch 15*a* is slightly different than the other catches 15*b*–15*d,* as will be explained fully hereinafter.

Each catch 15*a*–15*d* is manufactured with an elongated strip section 25 of rectangular cross section. To strengthen the catches, the respective strip sections 25 may be formed with longitudinally extending ribs 27, FIGS. 6 and 7. At each end of the strip section is a upstanding tab. In the illustrated construction, the tabs are U-shaped. When the catches are inserted in the cabinet channel 21, each catch has an upper U-shaped tab 29 and a lower U-shaped tab 31. The center leg 33 of the lower tab 31 is flush with the lower edge 34 of the catch. The center leg 35 of the upper tab 29 is recessed from the upper edge 37 of the catch by a predetermined amount, thereby creating a short protrusion 36, which may be approximately 0.25 inches long. When installed in the cabinet, the catches are in endwise abutment with the lower edge 34 of a catch resting on the upper edge 37 of the catch immediately below it. Consequently, a gap G exists between the center legs 33 and 35 of adjacent catches. For example, a gap Gc exists between catches 15*c* and 15*d,* and a gap Gb exists between catches 15*b* and 15*c.* To retain the catches within the cabinet channel, screws 39 pass through longitudinal slots 41 formed in the catches. The screws 39 are received in the panel 23. The catch slots 41 slide freely over shanks 43 of the screws 39, FIG. 3. When installed, gravity acts on the freely slidable catches such that the screws 39 are at the top ends of the associated slots. See FIGS. 2*a,* 4, and 6.

Figure 5:
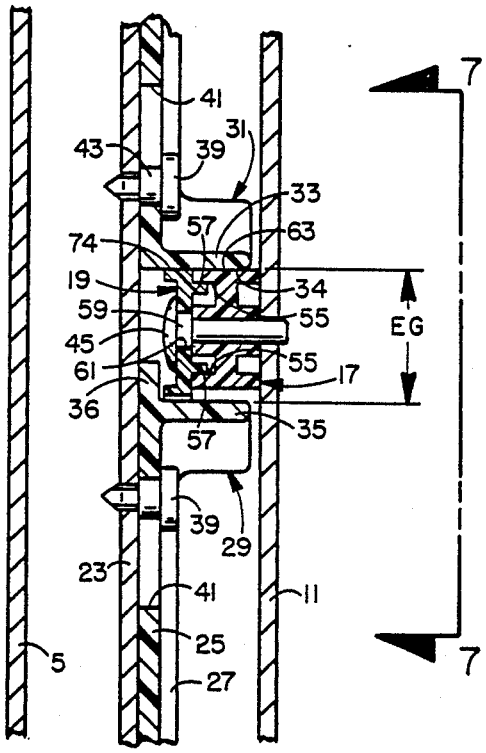
FIG. 5 is an enlarged partial cross sectional view taken along lines 5—5 of FIG. 2*b;*

Although the catches 15 have been described as being installed in the cabinet housing 2 with their respective protrusions 36 on the upper ends of the catches, the catches may be installed in a reversed manner. That is, the catches may be inverted from the orientation shown in the drawings such that the protrusions 36 are on the catch lower ends. In that case, tabs 31 become the upper tabs, and tabs 29 become the lower tabs. Also see FIGS. 5 and 6. Alternately, the center legs of the tabs may be recessed by approximately equal amounts from both ends of the catches. In all cases, the sizes and locations of the gaps G remain the same as those previously described. The function and operation of the modified tabs and catches are identical to those of the version shown and described in conjunction with the drawings.

The drawers 3*a*–3*d* have attached to their side walls 11 identical retainers 17*a*–17*d,* respectively. The retainers are attached to the drawer side walls by rivets 45. Each retainer is horizontally oriented and is formed with a tapered leading surface 47. The back ends 49 of the retainers may overhang the back walls 51 of the respective drawers, FIG. 3.

Figure 6:
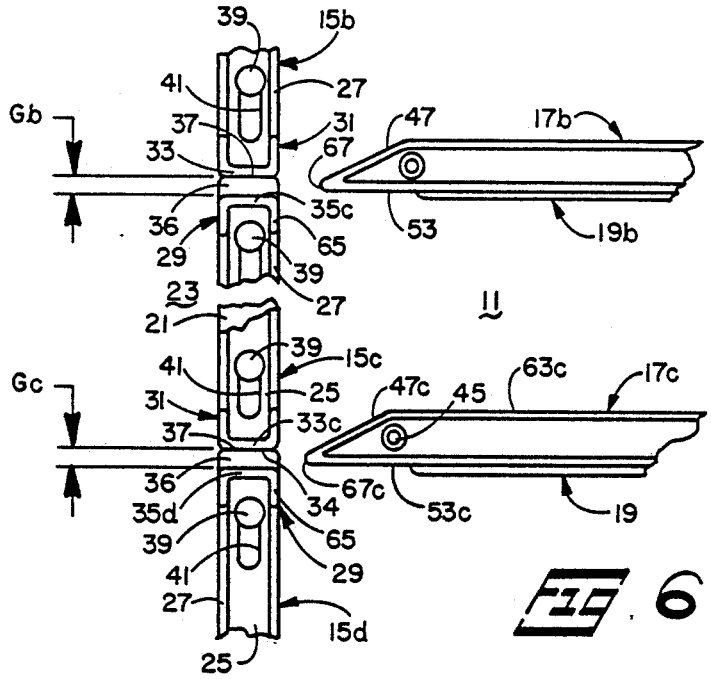
FIG. 6 is a view on a reduced scale taken along lines 6—6 of FIG. 4, but showing the safety interlock components associated with two cabinet drawers.
Figure 7:
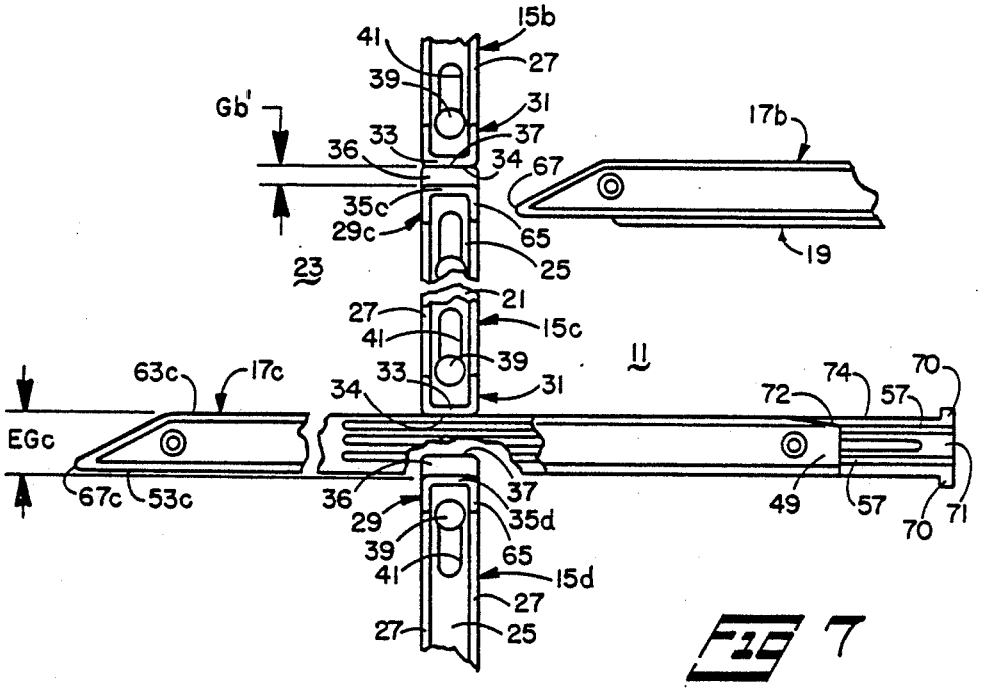
FIG. 7 is a view on a reduced scale taken along lines 7—7 of FIG. 5, but showing the safety interlock components associated with two cabinet drawers.

Looking primarily at FIGS. 2*a* and 6, when the drawers 3 are closed, the retainers 17*a*–17*d* are positioned such that their noses 67 are aligned with the respective gaps Ga-Gd between associated adjacent catches 15. Preferably, the bottom surface 53 of each retainer is approximately 0.06 inches above the top surface of the associated upper tab center leg 35.

Slidingly received in each retainer 17 is a retainer slide 19. To guide the retainer slide 19 in the respective retainer, the side wall of each retainer is formed with a longitudinal groove having opposed surfaces 55, FIG. 5. Received in the retainer groove are longitudinally extending ledges 57 on the slide that mate closely with the retainer groove surfaces 55. The top surface 63 of the retainer is desirably coplanar with th top surface 74 of the slide. The shanks 59 of the rivets 45 pass freely through slots 61 in the slide. The lengths of the slots 61 govern the travel of the slide relative to the retainer. The retainers and slides are positioned horizontally such that they pass in front of the catch protrusions 36. Also see FIG. 3.

Figure 4:
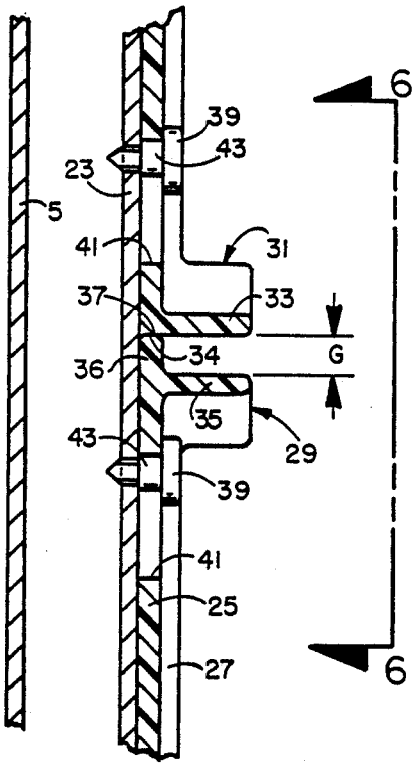
FIG. 4 is an enlarged partial cross sectional view taken along lines 4—4 of FIG. 2*a;*

To describe the operation of the safety interlock 13, it will be assumed that the filing cabinet 1 is initially in the condition shown in FIG. 2*a*. That is, all the horizontally moveable drawers 3*a*–3*d* are fully closed within the cabinet housing 2. In that condition, all the catches 15 are in their lowermost positions, being retained there against the force of gravity by the screws 39 that pass through the respective catch slots 41. The bottom edges 34 and top edges 37 of adjacent catches are in contact. The noses 67 of the retainers 17 lie behind the column of catches. Also see FIGS. 4 and 6.

It will be assumed that a person pulls drawer 3*c* to the open position, FIGS. 1 and 2*b*. Now returning to FIG. 6, pulling the drawer 3*c* toward the open position causes the nose 67*c* of retainer 17*c* to enter the gap Gc between the center legs 33*c* and 35*d* of adjacent catches 15*c* and 15*d*, respectively. The retainer bottom surface 53*c* passes freely over the center leg 35*d* of the catch 15*d*. The retainer tapered surface 47*c* strikes the lower edge 34 of the center leg 33*c* of the catch 15*c*. Consequently, the horizontal advancement of the drawer and retainer force the catch 15*c* upwardly; upward displacement is possible because of the catch slots 41.

As the drawer 3*c* is pulled open, the tapered surface 47*c* continues to displace the catch 15*c* farther upwardly. Eventually, the catch lower edge 34 rides onto the retainer upper surface 63*c*. At that point, the catch has reached the maximum upward displacement, and further opening of the drawer does not raise the catch 15*c* any further. Accordingly, an enlarged gap EGc, FIGS. 5 and 7, has been created. It will be noticed that catch 15*d* is unaffected by the opening of the drawer 3*c*.

With drawer 3*c* opened, it is impossible to open any of the drawers 3*a*, 3*b* above the opened drawer. That is because upward displacement of the catch 15*c* by the retainer 17*c* also displaced upwardly the catches 15*b* and 15*a* by the same amount. As a result, the gaps G that had been horizontally aligned with the associated retainers have also been displaced upwardly. For example, FIG. 6 shows the location of gap Gb when all the drawers are closed. Opening drawer 3*c* causes gap Gb to be displaced upwardly with respect to retainer I7*b* to the location shown at Gb' in FIG. 7. Consequently, a side leg 65 of the U-shaped tab 29 has been placed in the path of each of the retainers lying above the opened drawer. Specifically, the tab 29*c* of catch 15*c* has been displaced into the path of the retainer 17*b*. The drawers 3*a* and 3*b* can thus be moved only minimal amounts until the noses 67 of their respective retainers strike the displaced tab side legs 65.

Turning back to FIGS. 2*a* and 2*b*, the topmost catch 15*a* has a length such that the top edge 37*a* thereof is in contact with or in close proximity to the housing top wall 69 when any drawer 3 is opened. Since there is no drawer associated with the upper end of the catch 15*a*, no U-shaped tab is required at the upper end of that catch.

It is also impossible to open any drawer 3 beneath an opened drawer. Opening a drawer, such as drawer 3*c*, does not displace any of the catches, such as catch 15*d*, located below the opened drawer. Consequently, the gaps G remain aligned with the associated retainers 17 on the lower drawers, FIGS. 4 and 6. The retainer nose 67 of a lower drawer that is attempted to be opened will enter the associated gap. The retainer tapered surface 47 will strike the tab center leg 33 of the catch immediately above that retainer and try to displace that catch upwardly. Upward catch displacement is not possible, however, because vertical displacement of the catch is blocked by the retainer of the opened drawer. Particularly, in FIGS. 2*b* and 7, drawer 3*d* cannot be opened because the top tab leg 35*d* will strike the undersurface 53*c* of the catch 17*c*; upward displacement of catch 15*d* is thereby blocked. As a result, the safety interlock 13 of the present invention permits only one cabinet drawer to be opened at a time.

As illustrated in FIGS. 1 and 2*b*, the design of the filing cabinet 1 may be such that the back walls 51 of the drawers 3 are forward of the column of catches 15 when the drawers are in the fully opened position. To maintain the expanded gap EG when a retainer 17 has moved forward of the catches, the retainer slide 19 reciprocates within the retainer to remain in the expanded gap. Also see FIGS. 3, 5, and 7. To ensure that the slide positively remains between adjacent catches, one or more ears 70 are formed on the slide back end 71. As a drawer is pulled to the fully opened position, the ear 70 abuts a tab of an associated catch to retain the slide between the adjacent catches and thus maintain the expanded gap. When the opened drawer is closed, the slide back end 71 contacts the cabinet housing back wall 73 to telescope the slide into the retainer 17, FIGS. 2*a* and 3. To assure a smooth transition for the catch lower edge 34 between the slide top surface 74 and the retainer top surface 63 when a drawer is closed, the retainer top surface at the back end 49 thereof is fabricated with a taper 72, FIG. 7.

Looking again at FIGS. 2*a* and 2*b*, it will be noticed that top catch 15*a* is not needed for the operation of the safety interlock 13 as presently described. Since there are no drawers above the top drawer 3*a*, a catch such as catch 15*a* is not required to be displaced upwardly to block a higher drawer from opening when a lower drawer is opened. However, the presence of catch 15*a* is important for the reliable operation of the retainer slides 19. Assuming the conditions of FIG. 2*b*, it will be recalled that an attempt to open lower drawer 3*d* will cause retainer 17*d* to force catch 15*d* upwardly. Such upward force is resisted by the slide 19*c* on the opened drawer 3*c*, so that opening the drawer 3*d* is prevented. However, the upward force on the cantilevered slide 19*c* tends to bend it upwardly. Under extreme jerking of the drawer 3*d*, the slide l9*c* may fail. To prevent that possibility, the topmost catch l5*a* is utilized to transfer the upward force produced by the tapered surface 47*d* of the retainer 17*d* through all the catches and the slide of the opened drawer to the cabinet housing top wall 69, which is suitably designed to resist the upward force. Consequently, the slide of an open drawer is subject only to a compressive force when a person attempts to open a lower drawer. Since opening a drawer has no effect on the catches below that drawer, no catch is required below the retainer of the lowermost drawer. Thus, in FIGS. 2*a* and 2*b*, the lowermost catch is catch 15*d*, which lies above the retainer 17*d*.

To assure trouble free operation of the safety interlock 13 on a long term basis, the catches 15, retainers 17, and slides 19 are made of a friction free material. It has been found that a nylon plastic impregnated with approximately 33 percent by weight of a silicone and Teflon additive provides very slippery parts. As a result, the sliding actions between the catches, retainers, and slides induce very little drag when opening and closing drawers. Consequently, all the displaced catches fall easily by gravity in a reliable manner to remove the enlarged gap EG and reestablish the normal gap G when an opened drawer is closed.

Further in accordance with the present invention, the safety interlock may be manufactured in a manner that renders the filing cabinet very versatile for field alterations. Returning to FIG. 1, the filing cabinet 1 as exemplified therein may be perfectibly satisfactory to meet certain user storage requirements when purchased. However, the user may experience changes in the type of supplies or data media requiring storage. Rather than replace the entire filing cabinet, the present invention permits rearranging at least some of the drawers without affecting the safety interlock components associated with the undisturbed drawers. For example, any of the illustrated drawers 3 may be replaced with two shallower drawers, paper shelves, or hanger bars, if desired. Stiffening braces or spacers, not shown in FIGS. 1–7, can also be easily relocated.

Figure 8:
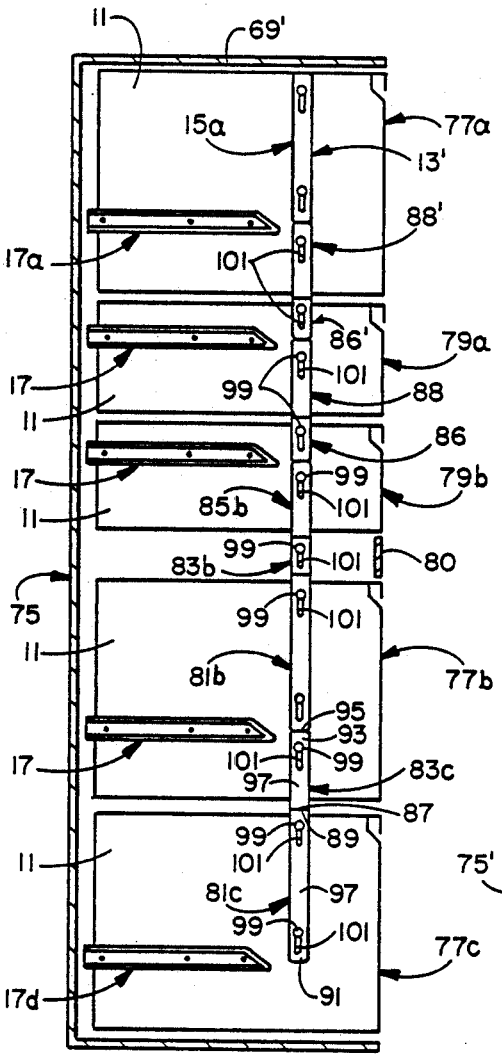
FIG. 8 is a cross sectional view similar to FIG. 2*a,* but showing a modified embodiment of the safety interlock that comprises the present invention.

Referring to FIG. 8, a filing cabinet 75 is depicted that is generally similar to the filing cabinet 1 described in conjunction with FIGS. 1–7. However, for illustration purposes a different combination of drawers will be assumed in FIG. 8. For clarity, the suspension systems 9 holding the drawers to the cabinet housing are omitted, as those members are well known in the art and form no part of the present invention. The cabinet 75 is shown with drawers 77*a*, 77*b*, and 77*c* that are assumed to be approximately 12 inches deep. Drawers 79*a* and 79*b* are assumed to be approximately 6 inches deep. A horizontal stiffening brace or spacer 80 may be approximately two inches deep.

The filing cabinet 75 includes a modified safety interlock 13' according to the present invention. The safety interlock 13' includes a retainer 17 on each of the drawers 77, 79 that is identical to the retainer described previously in connection with the safety interlock 13. The modified safety interlock also includes a retainer slide associated with each retainer. For clarity, the slides are not shown in FIG. 8, as they are identical in construction and operation with the slides 19 described previously with regard to FIGS. 1–7.

In the preferred embodiment, versatility of the safety interlock 13' is accomplished by manufacturing and installing the catches such that they have respective ends that approximately coincide with the top and bottom planes of the various drawers 77 and 79. Before describing the other catches, it will be noticed in FIG. 8 that catch 15*a* is employed in association with drawer 77*a* above the retainer 17*a*. The catch 15*a* is identical to the catch 15*a* illustrated and described in connection with FIGS. 1–7.

In FIG. 8, catch 81*c* is employed above the retainer 17*d* of the drawer 77*c*. The catch 81*c* does not extend from the retainer 17*d* of drawer 77*c* to the retainer of drawer 77*b*. Rather, the catch 81*c* terminates in a top edge 87 at approximately the level of the top of the drawer 77*c*. A second catch 83*c* having a bottom edge 89 extends from the catch 81*c* to the retainer of the drawer 77*b*. The lower end 91 of catch 81*c* is identical to the lower ends of the catches 15*a*–15*d* described previously. That is, the lower end 91 includes a tab, which, as previously described, may have a generally U-shape. Similarly, the upper end 93 of catch 83*c* is identical to the upper ends of the catches 15*b*–15*d*, having a U-shaped tab recessed from the top edge 95. The upper end of catch 81*c* and lower end of catch 83*c* do not include tabs. Rather, their respective strip sections 97 abut directly at edges 87 and 89. Like the catches 15, catches 81*c* and 83*c* are held to the cabinet 75 by screws 99 passing through appropriate slots 101.

In a similar manner, catches 81*b*, 83*b*, and 85*b* are stacked between the retainers 17 of drawer 77*b* and the drawer 79*b*. Catch 83*b* has two flat edges, i.e., catch 83*b* has no tabs, that abut flat edges of the catches 81*b* and 85*b*. Screws 99 and slots 101 are employed to retain the catches 81*b*, 83*b*, and 85*b* on the cabinet. The lower end of catch 81*b* and the upper end of catch 85*b* are formed with flush and recessed tabs, respectively. When the catches 81*c* and 81*b* are placed in edgewise contact, the center legs of their respective tabs define a gap for receiving the retainer of drawer 77*b*.

Catches 86 and 88 are stacked between the retainers 17 of the drawers 79*a* and 79*b*. The lower end of the catch 86 and the upper end of the catch 88 are formed with flush and recessed tabs, respectively. The catches 86 and 88 abut at flat ends in their respective strip sections. The usual gap is formed between the tabs of the abutting edges of catches 85*b* and 86. A pair of catches 86' and 88' identical to catches 86 and 88, respectively, are employed between the retainers of the drawers 79*a* and 77*a*.

The operation of the safety interlock 13' is identical to that of safety interlock 13 described previously with respect to FIGS. 1–7. Only the number and lengths of the catches have changed from the embodiment described previously.

Figure 9:
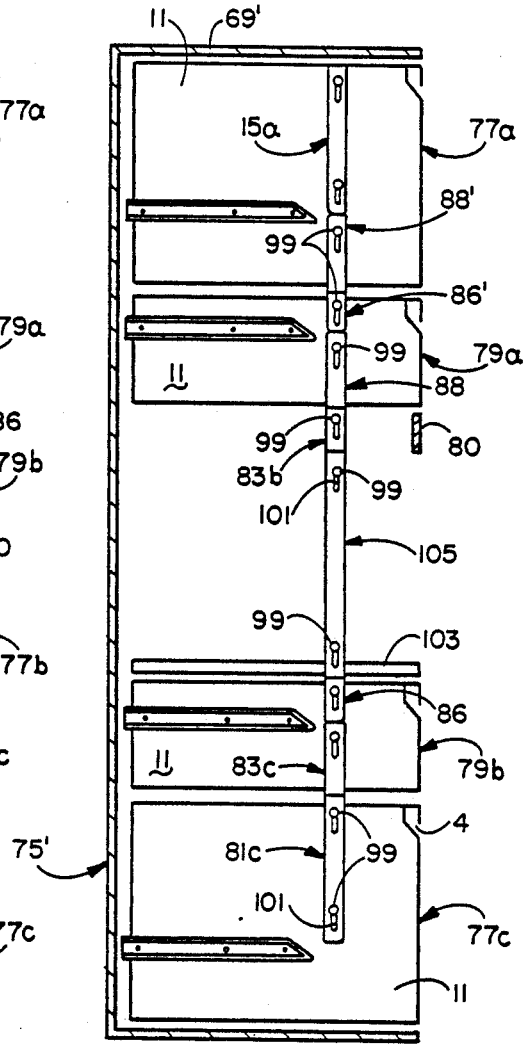
FIG. 9 is a cross sectional view similar to FIG. 8, but showing a modified arrangement of the components that are includable in a filing cabinet according to the present invention.

The advantage of the safety interlock 13' lies in its versatility, as is readily seen with reference to FIGS. 8 and 9. It will be assumed that a user of the file cabinet 75 requires a modification of the drawers 77, 79 to suit changed storage needs. FIG. 9 illustrates a representative modified cabinet 75' that is easily converted from the cabinet 75. In FIG. 9, drawer 77*b* has been replaced by a paper shelf 103 that attaches to the cabinet side walls in any suitable manner. In addition, drawer 79*b* has been moved to be between drawers 79*a* and 77*c*. The location of the spacer 80 has also been changed. The foregoing rearrangement is possible without any disturbance to the safety interlock components associated with the unchanged drawers 77*a*, 79*a*, and 77*c*. Catches 15*a*, 88', 86', 88, and 81*c* require no changing. Catch 83*c* also need not be changed. Catch 86, previously used between drawers 79*a* and 79*b*, can be moved to lie above catch 83*c*. Removal and replacement of catches is easily accomplished by means of the screws 99. The catch 83*b* associated with spacer 80 is moved to underlie catch 88. A new catch 105, which need have no tabs, is interposed between the catches 83*b* and 86. Only catches 81*b* and 85*b* are replaced, thereby keeping conversion expense to a minimum. In that manner, rapid and easy cabinet modification is possible by rearranging and replacing only the catches associated with the new or rearranged storage components.

Thus, it is apparent that there has been provided, in accordance with the invention, a safety interlock that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A safety file cabinet comprising:

a. a housing having a side wall and an open front;

b. a plurality of vertically aligned drawers;

c. suspension means attached to the housing and the drawers for reciprocating the drawers between opened and closed positions relative to the housing open front;

d. a plurality of catches, each catch being of single piece construction and having elongated strip sections and first and second ends and being vertically aligned in a column on the housing side wall with adjacent catches being in endwise abutting contact and being adapted to reciprocate vertically on the cabinet side wall, the ends of adjacent catches having respective tab means for defining vertical gaps between the respective adjacent catches wherein the strip section of each catch is fabricated with at least one longitudinally extending slot therein, and each catch is laterally retained to the cabinet housing by a headed fastener passing through the strip section slot and fastened to the housing to thereby enable catch reciprocation along the housing and prevent relative lateral motion between the catch and the housing, and wherein the catch tab means comprises:

i. a first generally U-shaped tab having a center leg and side legs, the tab center leg being flush with the edge of the first end, the tab center and side legs being approximately the same thickness as the strip section; and ii. a second generally U-shaped tab having a center leg and side legs, the tab center leg being spaced a predetermined distance from the edge of the second end, the tab center and side legs being approximately the same thickness as the strip section; and e. actuator means mounted to each drawer for entering the gap defined by the tab means of two adjacent catches when the associated drawer is pulled to the opened position and for displacing upwardly any catches above the actuator means of the opened drawer to enlarge the gap and to displace the side legs of the first tabs of any catches above the actuator means of the opened drawer into the paths of the actuator means of any drawers located above the opened drawer to thereby prevent opening any drawers located above the opened drawer, the actuator means leaving undisplaced any catches located below the actuator means of the opened drawer, the actuator means of the opened drawer being in the path of any catches located below the actuator means of the opened drawer to thereby prevent upward displacement of any catches below the actuator means of the open drawer, so that only one cabinet drawer at a time can be opened.

2. A safety filing cabinet comprising:

a. a housing having a side wall and an open front;

b. a plurality of vertically aligned drawers;

c. suspension means attached to the housing and the drawers for reciprocating the drawers between opened and closed positions relative to the housing open front;

d. a plurality of elongated catches having first and second ends and being vertically aligned in a column on the housing side wall with adjacent catches being in endwise abutting contact and being adapted to reciprocate vertically on the cabinet side wall, the ends of adjacent catches having respective tab means for defining vertical gaps between the tab means of the respective adjacent catches, wherein the tab means comprises:

i. a first tab attached to the catch first end and having a narrow center leg that is flush with the edge of the catch first end; and ii. a second tab attached to the catch second end and having a narrow center leg that is recessed a predetermined distance from the edge of the catch second end, the center legs of the first and second tabs of abutting adjacent catches defining the gaps between the respective adjacent catches; and e. actuator means mounted to each drawer for entering the gap defined by the center legs of the tabs of two adjacent catches when the associated drawer is pulled to the opened position and for displacing upwardly any catches above the actuator means of the opened drawer to enlarge the gap and to displace any catches above the actuator means of the opened drawer into the path of the actuator means of any drawers located above the opened drawer to thereby prevent opening any drawer located above the opened drawer, the actuator means of the opened drawer leaving undisplaced any catches located below the actuator means of the opened drawer, the actuator means of the opened drawer being in the path of any catches located below the actuator means of the opened drawer to thereby prevent upward displacement of any catches below the actuator means of the opened drawer, wherein the actuator means comprises:

i. an elongated retainer mounted to the drawer and adapted to enter and pass through the associated gap defined by the center legs of the first and second tabs of two adjacent catches and to enlarge the gap, the retainer defining a longitudinal groove having opposed parallel surfaces; and ii. slide means reciprocatingly received in the retainer for remaining in the enlarged gap between adjacent catches when the retainer passes through the gap, the slide means comprising a slide having parallel ledges received between the retainer groove parallel surfaces for reciprocation therealong, the slide defining at least one longitudinal slot, the slide being reciprocatingly attached to the retainer by at least one fastener that passes through the slide slot and that fixedly mounts the retainer to the drawer.

3. In a filing cabinet having a housing with a side wall; and a plurality of drawers mounted for horizontal reciprocation within the housing between opened and closed positions, a safety interlock for preventing more than one drawer from being opened at a time comprising:

a. actuator means attached to each cabinet drawer for horizontal reciprocation with the drawer, wherein the actuator means comprises:

i. a retainer fixedly attached to each drawer and adapted to enter and pass through the associated gap between adjacent catches when the drawer is opened and to enlarge the gap, the retainer being formed with a longitudinal groove having parallel opposed surfaces;

ii. a slide reciprocably received and retained within each retainer and adapted to remain in the enlarged gap when the drawer has been opened to a position whereby the retainer has passed through the enlarged gap, the slide being formed with at least one longitudinally extending ledge adapted to reciprocatingly fit between the retainer groove parallel surfaces and at least one longitudinal slot; and iii. fastener means passing through the slide slot and retainer for fixedly holding the retainer to the drawer and reciprocatingly holding the slide to the retainer; and b. a plurality of elongated catches mounted for vertical reciprocation on the housing wall, the catches being in abutting endwise relationship in a vertical column, the catches having upper and lower ends separated by respective strip sections, the upper and lower ends of each catch being formed with respective tab means integral with the strip sections for cooperating with the tab means on the ends of the respective adjacent catches to define vertical gaps therebetween in alignment with the actuator means on each drawer, wherein the tab means comprises a relatively thin center leg and at least one relatively thin side leg and wherein the center legs of the tabs of adjacent catches cooperate to form the gaps between adjacent catches, so that opening a drawer causes the associated actuator means to enter the gap between the associated adjacent catches to upwardly displace any catches located above the actuator means of the opened drawer and to block upward displacement of any catches located below the actuator means of the opened drawer.

4. In combination with a filing cabinet having a housing; and a plurality of horizontally reciprocable drawers for opening and closing relative to the housing, a safety interlock for preventing more than one drawer from being opened at a time comprising:

a. an elongated retainer fastened to each drawer and having leading and trailing ends and an upper surface and defining a longitudinal groove;

b. an elongated slide received in each retainer groove and defining at least one longitudinal slot and having leading and trailing ends and an upper surface generally coplanar with the retainer upper surface;

c. at least one rivet loosely passing through each slide slot and associated retainer to permit reciprocation of the slide in the retainer groove and to fixedly attach the retainer to the associated drawer;

d. a plurality of elongated catches having upper and lower ends and being mounted in the cabinet housing in a vertical column with the ends of respective adjacent catches being in abutting relationship, each catch being formed with respective tabs at the upper and lower ends thereof, the tabs of adjacent abutting catches cooperating to define gaps of predetermined spacing therebetween aligned with the retainers and slides of the respective drawers to permit the leading end of the retainer of a selected drawer to enter a gap and strike the upper cooperating tab with the retainer upper surface to displace upwardly any catches located above the retainer of the selected drawer and thereby create an enlarged gap, the upper cooperating catch tab being in contact with the retainer upper surface, the tabs at the upper ends of the displaced catches being displaced into the paths of any retainers located above the selected drawer for preventing the retainer of any non-selected drawer from entering any gap, at least the slide of the selected drawer always being in the enlarged gap and in the path of any catches located below the retainer of the selected drawer to thereby prevent upward displacement of any catches below the retainer of the selected drawer to thereby prevent any non-selected drawer from being opened, each catch defining at least one longitudinally extending slot; and e. at least one screw loosely passing through each catch slot for reciprocably mounting the catch to the housing.

5. In a filing cabinet having a housing with a side wall and a plurality of drawers having respective selected heights and mounted for horizontal reciprocation within the housing between respective opened and closed positions, the drawers being removable from the housing, at least one selected drawer being replaceable by selected other drawers having different heights, the total height of the selected other drawers being no greater than the height of the selected drawer replaced thereby, the drawers including a first drawer defining a top plane and a bottom plane and a second drawer defining a top plane and a bottom plane, the second drawer being mounted vertically above the first drawer, a safety interlock for preventing more than one drawer from being opened at a time and for enabling the selected drawer to be removed from the housing and replaced with the selected other drawers without disturbing the safety interlock components associated with unchanged drawers comprising:

a. actuator means mounted to each drawer at a predetermined distance from the respective bottom planes thereof for horizontal reciprocation therewith; and b. a first catch vertically mounted in the housing wall between the actuator means of the first and second drawers for being upwardly displaced by the actuator means of the first drawer when the first drawer is opened, the first catch defining upper and lower tabs separated by a strip section, the strip section of the first catch being severed approximately in line with the top plane of the first drawer to thereby form two separate pieces in an abutting relationship for being displaced in unison with each other, each tab having a center leg and at least one side leg, the lower tab center leg being in the path of the actuator means of the first drawer for being struck thereby and displaced upwardly when the first drawer is opened, the upper tab side leg being below the actuator means of the second drawer when the first drawer is closed and being displaced into the path of the actuator means of the second drawer when the first drawer is opened to thereby prevent the second drawer from being opened while the first drawer is open, so that only the catch pieces associated with a replaced drawer need be removed when replacing the drawer to thereby permit interchanging selected drawers without disturbing the catch pieces associated with unchanged drawers.

6. The file cabinet of claim 5 further comprising:

a. at least a third drawer having top and bottom planes and being mounted vertically above the second drawer for horizontal reciprocation within the cabinet housing between opened and closed positions; and b. at least a second catch vertically mounted in the housing wall between the actuator means of the second and third drawers for being upwardly displaced by the actuator means of the second drawer when the first drawer is closed and the second drawer is opened, and for being upwardly displaced by the first catch when the first drawer is opened and the second drawer is closed, the second catch defining upper and lower tabs separated by a strip section that is severed approximately in line with the top plane of the second drawer to thereby form two separate pieces in abutting relationship for being displaced in unison with each other, each tab having a center leg and at least one side leg, the lower tab center leg of the second catch being in the path of the actuator means of the second drawer for being struck thereby and displaced upwardly when the first drawer is closed and the second drawer is opened, the second catch upper tab side leg being below the actuator means of the third drawer when the first and second drawers are closed and being displaced into the path of the actuator means of the third drawer when the first or second drawer is opened.

* * * * *